US005409204A

United States Patent [19]

Strohmeyer et al.

[11] Patent Number: 5,409,204

[45] Date of Patent: Apr. 25, 1995

[54] SINGULATOR ASSEMBLY HAVING A BUFFER WITH A BIASED ARM

[75] Inventors: James J. Strohmeyer, Hampstead; Robert M. Swec; Earl W. Tuckey, both of Baltimore; Robert S. Frantz, Phoenix; Michael J. Wild, Cockeysville; Jeffrey R. Nice, Sykesville; William Z. Smith, Jr., Reisterstown; Steven L. Heishman, Millersville; Horace W. Weeks, Towson, all of Md.

[73] Assignee: Duchossois Industries, Inc., Elmhurst, Ill.

[21] Appl. No.: 112,363

[22] Filed: Aug. 27, 1993

[51] Int. Cl.[6] ..... B65H 5/22

[52] U.S. Cl. ..... 271/3.1; 271/34; 271/150; 271/265; 271/270

[58] Field of Search ..... 271/3.1, 34, 35, 94, 271/150, 151, 157, 270, 122, 265, 273, 274

[56] References Cited

U.S. PATENT DOCUMENTS 3,088,144 5/1963 Weeks .
3,664,661 5/1972 Weeks et al. .
4,177,982 12/1979 Bewersdorf et al. ..... 271/94 X
4,893,804 1/1990 Sasage et al. ..... 271/3.1
5,074,540 12/1991 Belec et al. ..... 271/34
5,257,777 11/1993 Kalika et al. ..... 271/35

FOREIGN PATENT DOCUMENTS 1182136 2/1985 Canada .

*Primary Examiner*—Robert P. Olszewski
*Assistant Examiner*—Boris Milef
*Attorney, Agent, or Firm*—Lowe, Price, LeBlanc & Becker

[57] ABSTRACT

A singulator of the friction belt type capable of synchronous or asynchronous modes of operation is described. The singulator includes a buffer assembly for accepting a shingled stream of documents, a feeder pinch belt for extracting the first document from the buffer and a scanner for scanning the document as it passes through the feeder into an accelerator which is also a pinch belt. The accelerator accelerates the document to a constant speed leaving the singulator. A control means is provided which operates coupled to the feeder drive and the scanner so that the next upstream document is extracted a predetermine time after the first document leaves the accelerator.

6 Claims, 3 Drawing Sheets

SINGULATOR ASSEMBLY HAVING A BUFFER WITH A BIASED ARM

FIELD OF THE INVENTION

This invention relates to a device useful in sorting documents such as letter mail and postcards for singulating individual pieces from a shingled stream for downstream scanning. The device is particularly suited for use in a mail sorter wherein individual pieces vary in size and thickness.

BACKGROUND OF THE INVENTION

Automated mail sorting machines such as is disclosed in U.S. patent application Ser. No. 07/961,980 filed Oct. 6, 1993, the disclosure of which is hereby incorporated by reference, and assigned to the U.S. Postal Service depends upon a reliable singulator. In that automated machine, a stack of mail is initially fed into a shingler which produces a shingled stream of mail. The singulator then separates each piece and orients it on a conveyor with a predetermined distance between the trailing edge of a leading piece and the leading edge of the next trailing piece. Downstream of the singulator then, scanners are provided which scan, for example, a bar code thereon and, on the basis of that scan, the microprocessor sorts the mail or other documents. In the above-identified mailing machine, typically 3,000 pieces of mail are subjected to three passes and thereby may be sorted by address and doorway for an individual mail carrier's route, in a matter of minutes.

Singulators are also used for the controlled input of machinable letter mail to most automated mail processing equipment including facer-cancellers, optical character readers, bar code readers, labelling machines and mail sorting equipment as described above. The singulator in general accepts either a stack of edged letters and postcards from a feed table or a continuous shingled stream of letters and postcards from an upstream source and separates the front or foremost mail piece by feeding it laterally while retarding the remaining mail pieces. This action produces a gap between the trailing edge of the first mail piece and the leading edge of the next trailing mail piece to be singulated. The individual letters and postcards can then be scanned, cancelled, or the like, depending upon the function of the machine.

There are many different types of letter or document singulators in use for commercial and U.S. Postal Service mail processing operations. Such machines usually are classified as synchronous or asynchronous and vacuum or friction types. A synchronous singulator feeds each mail piece from a stack or shingled stream with the leading edges spaced a constant (fixed) pitch as they move along the downstream transport. Asynchronous singulators feed each mail piece with a constant gap between the trailing edge of the upstream letter and the leading edge of the downstream letter and, therefore, they are fixed gap singulators. Vacuum singulators are characterized by the use of a negative pressure to separate the first mail piece from each stack. The vacuum can be applied by means of vacuum cups attached to a reciprocating arm or a perforated belt or belts moving across a vacuum manifold. Friction singulators use either friction wheels or belts that are located at the front of the mail stack or stream and apply the separating force to the first mail piece.

Since the separating force on the front mail piece usually tends to carry more than one mail piece at a time from the stack, a stripper mechanism is required at the exit point from the stack to retard all letters except the first one. The stripper can be a wiper, several small, spring loaded friction pads or a more positive counter rotating stripper wheel or belt. In each case, the stripper mechanism must apply sufficient force on the letter or letters to stop their forward motion while not restricting the forward motion of the first letter.

After initiating the singulation function with the vacuum or friction wheel or belt, the first mail piece reaches a zone located a predetermined distance from its starting point where it must be accelerated to the output transport. An adjacent pair of friction covered pulleys or pinch belts provide the accelerating force for each letter.

SUMMARY OF THE INVENTION

It has been discovered that a high speed friction-type singulator can be developed that will accept a shingled stream of letters and postcards from a variable speed transporter belt, and buffer a small stack of this mail while the singulator feeds each mail piece in a serial end-to-end fashion. The singulator assembly of this invention is a friction belt type singulator that can operate in either of the synchronous or asynchronous modes.

The singulator of this invention is intended to accept a shingled stream of letters, postcards, or other documents which accumulates as a small stack in a buffer assembly. A feeder belt and counter rotating stripper belt act upon the buffered stack to extract the first piece into a pinch area whereby each piece is then advanced through sensors to a pair of accelerator belts which operate at a constant speed and feed the scanned letter into a sorter system. This then results in a gap between the lead mail piece and the remainder of the shingled mail stream which is controlled either to provide fixed pitch mail pieces wherein the leading edge of each piece is a predetermined distance from the leading edge of the next piece, or a fixed gap wherein the trailing edge of the leading mail piece is a predetermined distance from the leading edge of the trailing piece.

The device of this invention further includes a quick release mechanism for easy removal of jams at the pinch point between the feeder belt and stripper belt combination, and further at the pinch point between the accelerator belts so that if mail becomes jammed, it may be quickly removed.

Accordingly, it is an object of this invention to provide an extremely reliable and fast singulator for a shingled stream of documents including mail pieces which can operate either synchronously or asynchronously.

It is a further object of this invention to provide a friction belt-type singulator wherein the input thereto is a shingled stream of mail pieces or the like and whereby an initial stripper feeder belt combination collects with a downstream accelerator belt combination to provide either a predetermined pitch for the singulated mail pieces or a predetermined gap between each piece based upon an optical scan thereof as it passes through the feeder section.

It is still another object of this invention to provide an efficient machine for singulating a shingled stream wherein a first piece of mail in the stream is fed by a belt input across the light path of an LED element which proceeds to scan across the length of the mail piece until it enters the accelerator and the trailing edge is determined, whereupon after a predetermined interval of time, the second mail piece is started to the accelerator whereby the resulting singulated mail stream will have either a constant pitch or a constant gap between the pieces of mail as determined by the length of time permitted.

These and other objects will become readily apparent with reference to the drawings and following description wherein:

DETAILED DESCRIPTION OF THE INVENTION

Figure 1:
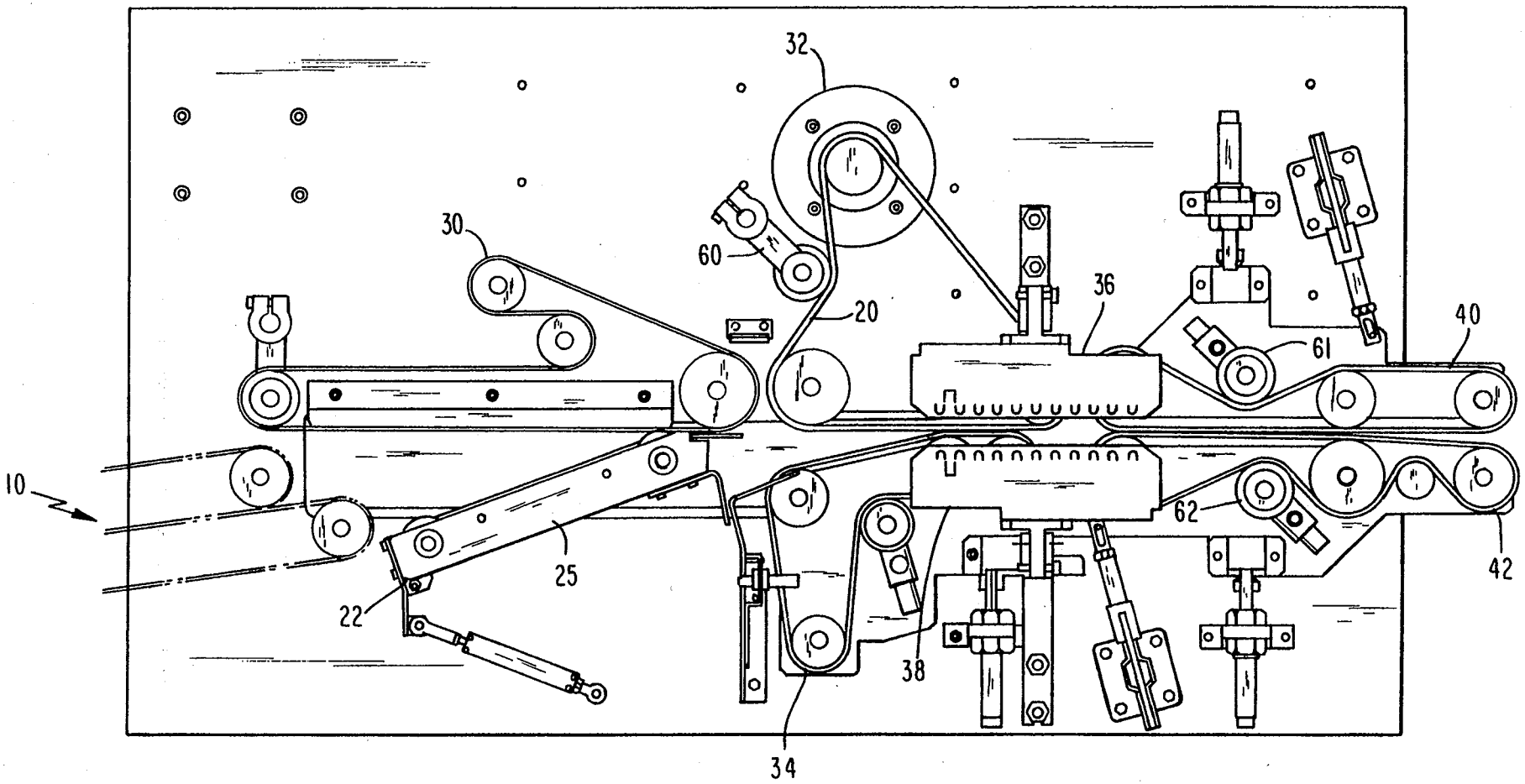
FIG. 1 is a top view of the singulator of this invention.
Figure 2:
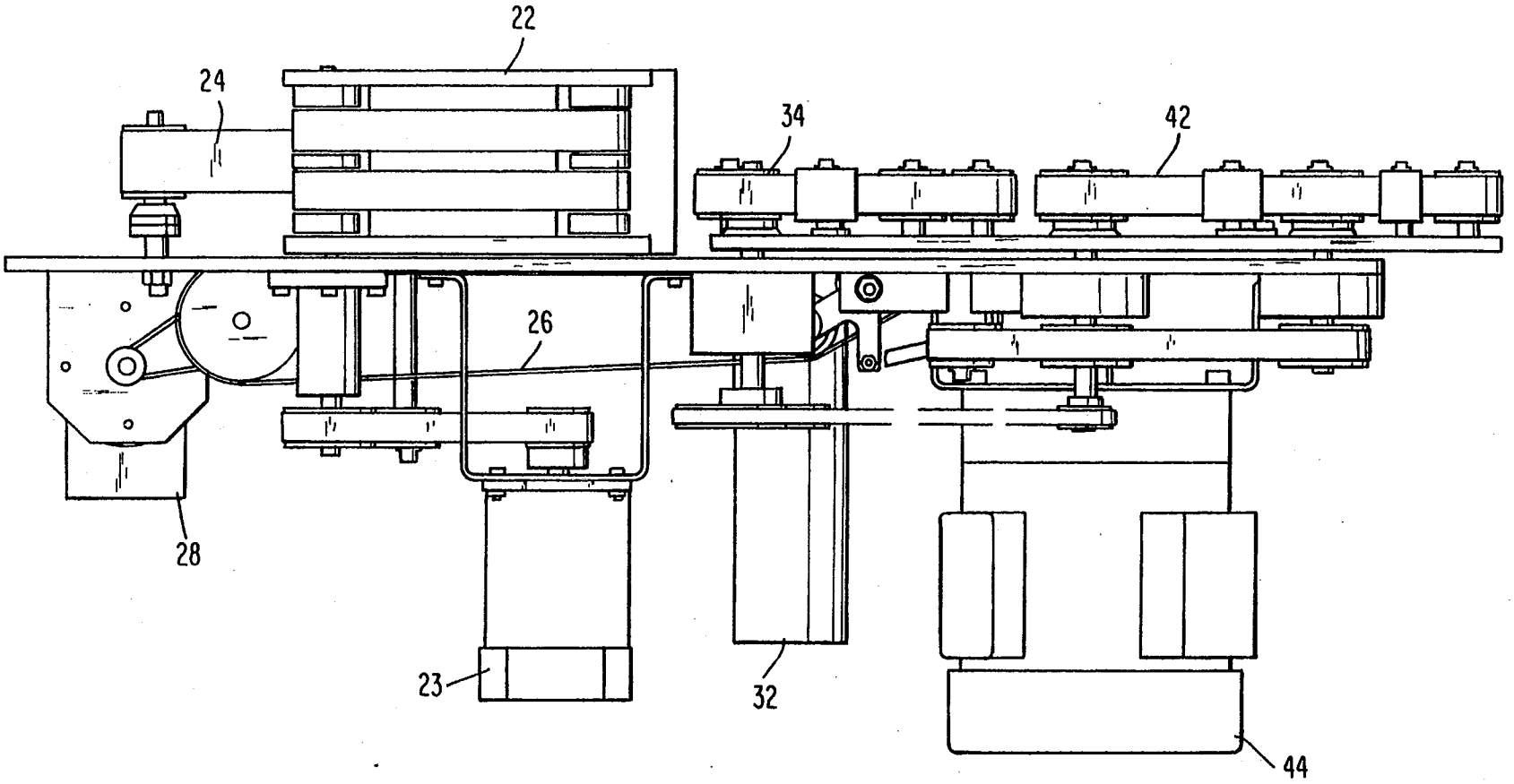
FIG. 2 is a side view of the singulator device of FIG. 1.

With attention to the drawings and to FIGS. 1 and 2, in particular, the device of this invention consists mainly of a series of transport belts that move letters, postcards or other documents from the left side toward the right side of FIG. 1. A shingled stream of mail pieces enters the device of this invention from a pair of pinch belts 10 shown in phantom in FIG. 1. The mail pieces in a shingled stream are driven up to the singulator servo belt 20 by the buffer arm assembly 22 including feeder belt 20 by the pivotal buffer arm assembly 25 including a pair of buffer arm belts 24 as shown in FIG. 2. A buffer belt 30 across the transport path on the opposing side of belts 24 and a horizontal belt 26 below the transport path are also provided to facilitate leading the mailstream to the feeder belt 20. As the mail enters the buffer area, the buffer arm assembly 25 pivots around the left side shaft 27, thus allowing the mail to collect in the area between the buffer arm assembly 25 and the buffer belt 30. When the mail pieces reach the feeder belt 20 with a servo drive 32, the singulator servo drive is actuated so that the feeder belt rotates counterclockwise as shown in FIG. 1. A rubber compound is laminated on the outside of the feeder belt to provide a high friction surface that urges the leading edge of the front piece of mail toward the right. If more than one letter enters the gap between the feeder belt and the counter rotating stripper belt 34, a sheer force is set up allowing only one mail piece to proceed between the two belts.

Figure 3:
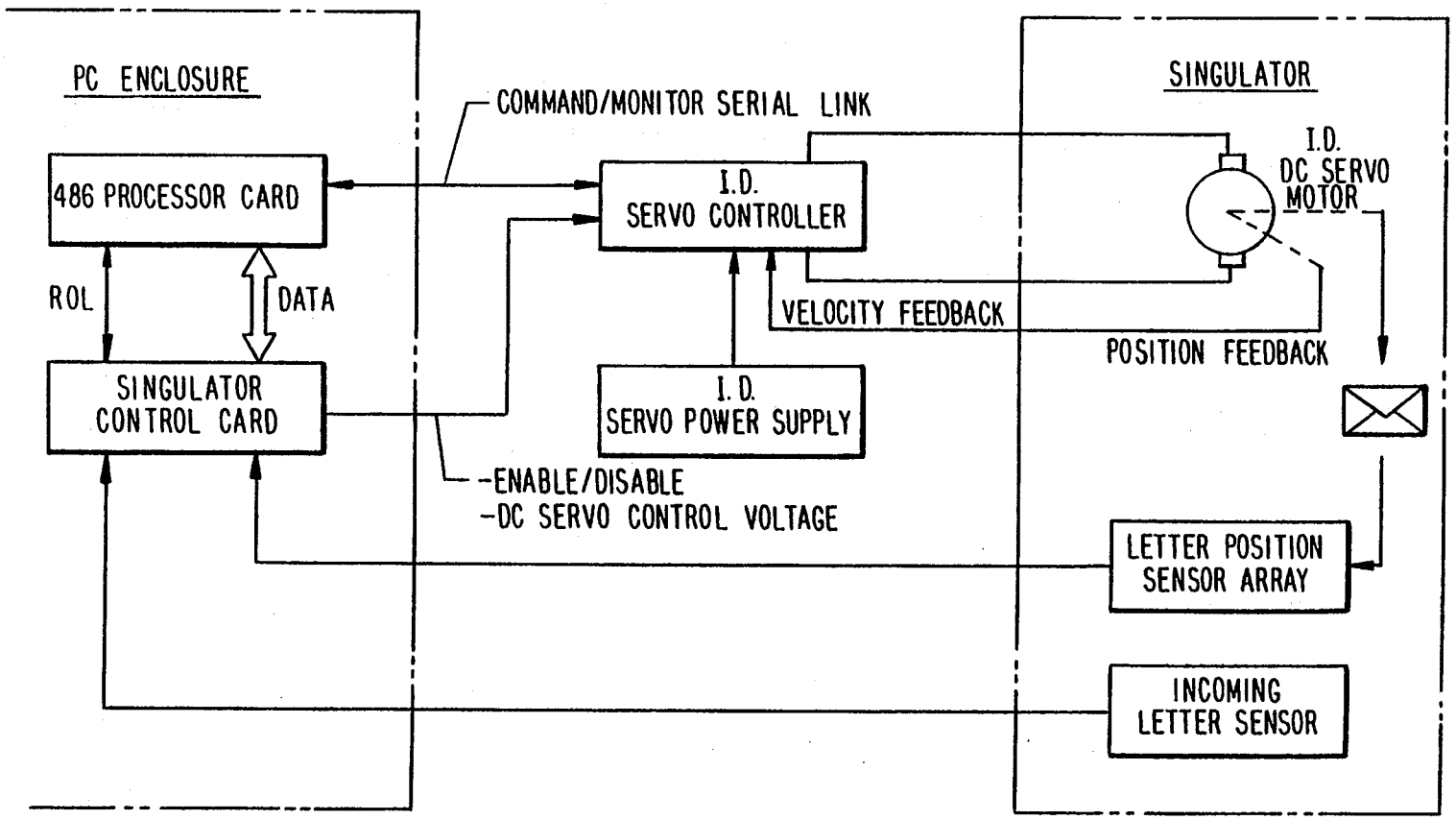
FIG. 3 is a block diagram of the singulator control system of this invention.

A photo cell array consisting of a bank of emitters 36 and receivers 38 are provided located at the output of the feeder and stripper belts and the input of the adjacent pair of accelerator belts 40 and 42 and is oriented so that each mail piece breaks the LED light path on each LED element as it proceeds into accelerator belts 40 and 42. In normal operation the belts 40 and 42 run at a constant speed of 130 inches per second. The singulator control system shown in FIG. 3 tracks the first letter until the leading edge of the letter is detected. It compares the trailing edge of the first letter to the leading edge of the next letter now held stationery by the stopped servo motor 32. When the desired gap has been generated, the servo motor 32 is energized by the control system, feeding the second letter into accelerator belts 40 and 42. This feed cycle continues until the supply of mail is exhausted or the machine is stopped. After the final mail piece of a batch is singulated, the LED photocell senses a lack of mail and disables the accelerator belt drive motor to prevent excessive wear and heat buildup between the feeder belt 20 and the counter rotating stripper belt 34.

The feeder belt 20, as described above, is driven by the servo motor 32 which operates in the position dependent (PD) mode as a velocity drive. An analog differential DC voltage, used to set the motor speed, is generated by a D/A convertor which is part of the control system computer responsible for singulator control. The control voltage can vary from zero to ten volts and regulates the servo controller which drives the motor.

The servo system utilizes several feedback loops. The current and velocity loop is closed inside the servo amplifier unit. The position loop is closed via an external photocell array which tracks the letter position. This information is presented to the computer for subsequent processing. The input servo voltage is under computer control based on mail position in the photocell array. Mail leaving the feeder belt enter the accelerator belt pair and exits the singulator. The accelerator belts 40 and 42 and the stripper belt 34 are driven by an AC induction motor 44 at a constant speed. An additional retroreflective sensor is used at the entrance of the feeder and stripper belts. It is used to start the servo motor when incoming mail is detected. Otherwise, the servo motor 32 is disabled allowing the feeder belt to rotate in the same direction as the stripper belt, driven thereby. Tensioner 60, 61, 62 and 63 are provided respectively on belts 20, 40, 42 and 34 to facilitate smooth operation of the belts by regulating the tension thereon in the conventional manner.

OPERATION

In order to understand the control sequence of the singulator of this invention, it is necessary to first understand the basic principle of friction singulation. The first set of belts, the feeder belt 20 and the counter-rotating stripper belt 34 take the input stream of mail and produce and overlapping stream of mail at the output. This process is known as shingling. The shingled mail from the output of the first set of belts is then fed to the second set of belts known as accelerator belts 40 and 42. These belts are running significantly faster than the shingled mail stream which is being fed into them. The result is that the accelerator belts grasp the lead piece of the shingled stream, pull it away from the others, and transport it quickly to the outside take away device which is usually another pair of transport belts. This mail piece is now separated or singulated from the remainder of the mail pieces. The shingled mail stream from the first set of belts then is moved forward and the accelerator belts once again grab the new lead piece and the process repeats itself. The continuous repetition of this process is singulation.

As noted above, this invention is capable of singulating mail in two different modes. The first of these modes is a fixed gap when the distance from the trail edge of one mail piece to the lead edge of the next is constant. This distance which is referred to as gap between the mail pieces is the basis of the term applied to this type of singulation. The second mode is fixed pitch wherein the distance from the lead edge of one mail piece to the lead edge of the next is held constant. This distance is referred to as the pitch of the mail stream, and is the basis of the term applied to this patent singulation.

The control sequence by which a constant gap is achieved is as follows:

1. The Server controlled feeder belt advances the shingled mailstream forward at full speed or approximately 130 inches per second.
2. When the lead piece of the shingled mailstream reaches the accelerator belt 40 and 42 as determined by the photocell array 36 and 38, the feeder belt 20 reduces to 40% of full speed or approximately 52 inches per second.
3. The lead mail piece is grabbed by the full speed accelerator belt and is separated from the remainder of the shingled stream at a rate determined by the difference in speed of the accelerator belt 40 and 42 and the feeder belt 20. This is 60% of full speed or approximately 78 inches per second.
4. When a gap is detected by the photocell array 36 and 38, between the lead mail piece and the remainder of the shingled mailstream, the feeder belt 20, and thus the shingled mailstream, is stopped.
5. The shingled mail stream is stopped for approximately 23 milliseconds at which time the gap with the lead mail piece will have widened to 3 inches.
6. The sequences are then repeated from step 1 above.

The control sequence by which the constant pitch is achieved is as follows:

1. The servo controlled feeder belt 20 advances the shingled mailstream forward at full speed or approximately 130 inches per second.
2. When the lead piece of the shingled mailstream reaches the accelerator belt (as determined by the photocell array 36 and 38) the feeder belt 20 reduces to 40% of full speed or approximately 52 inches per second. The time at which the lead edge of the mail pieces reaches accelerator belts 40 and 42 is recorded for future use.
3. The lead mail piece is grabbed by the full speed accelerator belts 40 and 42 and is separated from the remainder of the shingled stream at a rate determined by the difference in speed of the accelerator belt and the feeder belt. This is 60% of full speed or approximately 78 inches per second.
4. When a gap is detected by the photocell array 36 and 38 between the lead mail piece and the remainder of the shingled mailstream, the feeder belt and thus the shingled mailstream, is stopped.
5. The shingled mailstream is stopped for a period of time governed by the following equation:

time=((desired pitch)/130)−(travel time at full speed to last photocell in array)+(present time—time at step 2 above).

6. The sequence is then repeated from step 1.

The above sequences do not take into account the time it takes the shingled mailstream to accelerate or decelerate. To account for this, a self-compensating routine is used to adjust the amount of time the mailstream is stopped. The self-compensating routine measures the actual gap (or pitch) being generated between consecutive mail pieces and adjusts the stop time upward or downward accordingly in order to maintain a fixed gap (or pitch).

Of particular importance in the device of this invention are the two quick release mechanisms, 46 and 47 which permit easy removal of mail jams. Jam release mechanism 46 relieves the pressure at the pinch points between the stripper belt 34 and the feeder belt as well as the pinch point on the input end of the accelerator belts 40 and 42. This action is accomplished by operating the jam release mechanism 46 which allows both the stripper belt mounting plate, 50, and the accelerator belt mounting plate 48, to be pivoted outwardly thus, freeing any jammed mail in this area. Jam release mechanism 47 relieves the pressure at the pinch point on the output end of the accelerator belts 40 and 42. This action is accomplished in a similar fashion by unlatching the jammed release mechanism which allows the accelerator belt mounting plate 49 to pivot outwardly, thus freeing any jammed mail in this area.

Accordingly, in summary, the singulator of this invention utilizes a unique combination of a buffer assembly, a feeder assembly, and an accelerator assembly which are all disposed in a linear relationship to each other whereby when a mail piece enters the feeder assembly from the buffer assembly, the servo drive through use of friction grabs the leading edge of the piece of mail whereupon it is passed through a sensor array which picks up the leading edge and trailing edge as light paths are broken and notes the time. When the mail piece enters the accelerator belts which travel at a constant speed, the servo motor is disabled for a period of time to regulate the spacing between the mail piece in the accelerator belt section against the mail piece entering the feeder system. When the predetermined time period has elapsed, the servo is re-energized and the second mail piece passes through the system whereby the cycle is continually repeated so that the mail pieces are singulated in either a fixed gap between the trailing edge of the leading mail piece and the leading edge of the next, or a fixed pitch wherein the leading edges of each mail piece are a constant distance apart.

It will be readily seen by one of ordinary skill in the art that the present invention fulfills all of the objects set forth above. After reading the foregoing specification, one of ordinary skill will be able to effect various changes, substitutions of equivalents and various other aspects of the invention as broadly disclosed herein. It is therefore intended that the protection granted hereon be limited only by the definition contained in the appended claims and equivalents thereof.

We claim:

1. A document singulator for singulating a shingled stream of documents in a synchronous or asynchronous mode comprising:

buffer means for accepting an incoming shingled stream of documents and accumulating a stack thereof said buffer means including a biased arm, at least one drive belt mounted thereon, a coacting buffer feed belt spaced from said drive belt and means for pivoting said arm to increase the space between at least one end of said arm and said buffer feed belt.

feeder pinch belt means for extracting only the first document accumulated in said buffer means and advancing said document including a rotating, continuous friction feeder belt and drive means therefor and a counter rotating continuous stripper belt and drive means therefor;

scanner means downstream of said feeder belt means for scanning the leading and trailing edges of said document advanced by said feeder means;

accelerator pinch belt means for accepting said document advanced from said feeder belt means and discharging the same at a predetermined speed; and control means coupled to said scanner means and the drive means for said feeder belt for initiating extraction of a document from said buffer means responsive to the discharge of the next previous document from said accelerator means.

2. The singulator of claim 1 further comprising means coupled to said feeder belt means for removing a document jam therein.

3. The singulator of claim 2 further comprising means coupled to said accelerator belt means for relieving a document jam therein.

4. The singulator of claim 3 wherein said accelerator pinch belt means comprises a pair of rotating belts having predetermined tension thereon.

5. The singulator of claim 1 wherein said control means includes means for spacing the trailing edge of a first document a predetermined distance from the leading edge of the next upstream document leaving said accelerator means.

6. The singulator of claim 1 wherein said control means includes means for spacing the trailing edge of a first document a predetermined distance from the trailing edge of the next upstream document leaving said accelerator means.

* * * * *